US008122521B2

(12) United States Patent
Chiang

(10) Patent No.: US 8,122,521 B2
(45) Date of Patent: Feb. 28, 2012

(54) SWIMMING GOGGLES

(76) Inventor: Herman Chiang, Chung-Ho (TW)

( * ) Notice: Subject to any disclaimer, the term of this patent is extended or adjusted under 35 U.S.C. 154(b) by 242 days.

(21) Appl. No.: 12/558,742

(22) Filed: Sep. 14, 2009

(65) Prior Publication Data

US 2011/0047683 A1 Mar. 3, 2011

(30) Foreign Application Priority Data

Sep. 1, 2009 (TW) ..... 98216154 U

(51) Int. Cl.
*A61F 9/02* (2006.01)

(52) U.S. Cl. ..... 2/428; 2/448

(58) Field of Classification Search ..... 2/426, 428, 2/448

See application file for complete search history.

(56) References Cited

U.S. PATENT DOCUMENTS 7,007,311 B2 * 3/2006 Chiang ..... 2/448

(Continued)

*Primary Examiner* — Katherine Moran

(74) *Attorney, Agent, or Firm* — Cheng-Ju Chiang

(57) ABSTRACT

Swimming goggles include a left frame, a right frame and a connecting member integrally shaped, a pair of lenses received in the left frame and the right frame, buckles assembled on outward sides of the left frame and the right frame, and a nose support. The lenses respectively have first latches beside outward sides of the left frame and the right frame, and second latches beside inward sides of the left frame and the right frame. The buckles form first embedding portions for mounting with the first latches of the lenses. The nose support forms second embedding portions for assembling with the second latches of the lenses. During manufacturing, the nose support, the buckles and the lenses are assembled together, and are then shaped with the left frame, the right frame and the connecting member when the left frame, the right frame and the connecting member are shaped integrally.

13 Claims, 5 Drawing Sheets

U.S. PATENT DOCUMENTS 7,647,650 B2 * 1/2010 Chiang ..... 2/431

7,810,175 B2 * 10/2010 Chiang ..... 2/448

* cited by examiner

SWIMMING GOGGLES

BACKGROUND OF THE INVENTION

1. Field of the Invention

The present invention relates to swimming goggles, and particularly to swimming goggles which have a left frame, a right frame and a connecting member integrally formed, and is used comfortably and easily.

2. Related Art

Swimming goggles are generally categorized as two types: separate type and integral type. The separate type has a separate connecting member connecting a left frame and a right frame together; while the integral type has a left frame and a right frame integrally formed with a connecting member. In order to receive lenses in the left frame and the right frame retentively, the integral type of swimming goggles ought to be made of rigid material, and otherwise the lenses can not be held. Due to restraint of the rigid material, pads on the left frame and the right frame fail to have flexibility to touch a user's face comfortably. Moreover, the connecting member made of rigid material is too stuff to suit for users with different face profiles. Lack of flexibility increases risk of water leakage arising from unclosed touch of the left and the right frames to a user's face.

In addition, due to restraint of the rigid material, buckles of the integral type of swimming goggles have to be designed simply for positioning a head strap and can not adjust the head strap finely. In use, the swimming goggles have to be adjusted repeatedly and inconveniently.

SUMMARY OF THE INVENTION

Accordingly, an object of the present invention is to provide swimming goggles which are used conveniently and worn comfortably without risk of water leakage and which prevents from deformation of frames while pulling a head strap thereof.

The swimming goggles comprise a left frame, a right frame and a connecting member integrally shaped, a pair of lenses, buckles and a nose support. The left frame and the right frame respectively form inward surfaces and outward surfaces. Passageways are respectively defined between the inward surfaces and the outward surfaces. Assembling holes are respectively defined in outward sides of the left frame and the right frame. The lenses are respectively received in the passageways, and respectively have first latches beside outward sides of the left frame and the right frame, and second latches beside inward sides of the left frame and the right frame. A plurality of injection holes is defined in peripherals of the lenses. The buckles are respectively assembled on the assembling holes. Each buckle includes a base with an extending hole defined in the base. A first embedding portion is defined in the base for mounting with the first latch. The nose support includes a middle portion, and second embedding portions on both sides of the middle portion for assembling with the second latches of the lenses. During manufacturing, the nose support, the buckles and the lenses are assembled together, and are then shaped with the left frame, the right frame and the connecting member when the left frame, the right frame and the connecting member are shaped integrally.

DESCRIPTION OF THE PREFERRED EMBODIMENTS

Figure 1:
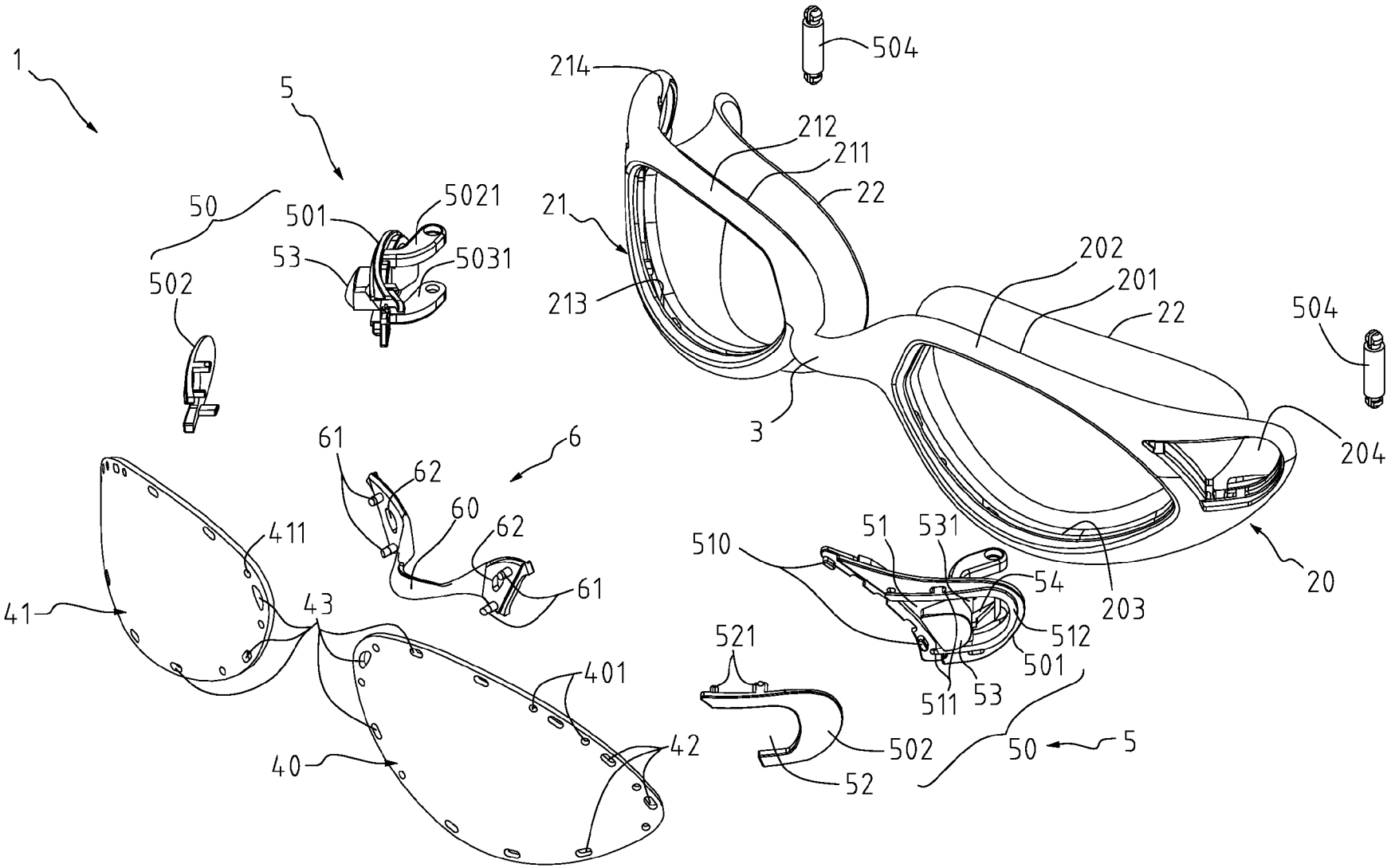
FIG. 1 is an exploded view of swimming goggles according to the present invention.

Referring to FIG. 1, swimming goggles 1 in accordance with the present invention comprise a left frame 20, a right frame 21, a connecting member 3, a pair of lenses 40, 41, buckles 5, and a nose support 6. The left frame 20 and the right frame 21 are integrally formed. During manufacturing, the nose support 6, the buckles 5 and the lenses 40, 41 are assembled together, and are then shaped with the left frame 20, the right frame 21 and the connecting member 3 when the left frame 20, the right frame 21 and the connecting member 3 are shaped integrally. The left frame 20, the right frame 21 and the connecting member 3 are made of Thermoplastic Rubber (TPR) which is featured of injection shaping and gluing. The left frame 20 and the right frame 21 respectively form inward surfaces 201, 211 and outward surfaces 202, 212. Passageways 203, 213 are respectively defined between the inward surfaces 201, 211 and the outward surfaces 202, 212 for receiving the eyeglass 40, 41. Assembling holes 204, 214 are respectively defined in outward sides of the left frame 20 and the right frame 21. Pads 22 are respectively formed on the inward surfaces 201, 211. The pads 22 are softer than the left frame 20 and the right frame 21 for touching a user's face comfortably.

The lenses 40, 41 are respectively received in the passageways 203, 213. The eyeglass 40, 41 respectively form first latches 42 beside outward sides of the left frame 20 and the right frame 21, and second latches 43 beside inward sides of the left frame 20 and the right frame 21. According to one embodiment of the present invention, the first latches 42 and the second latches 43 respectively include a plurality of embedding holes in the lenses 40, 41. A plurality of injection holes 401, 411 is defined in peripherals of the lenses 40, 41 for holding plastic when shaping.

Figure 4:
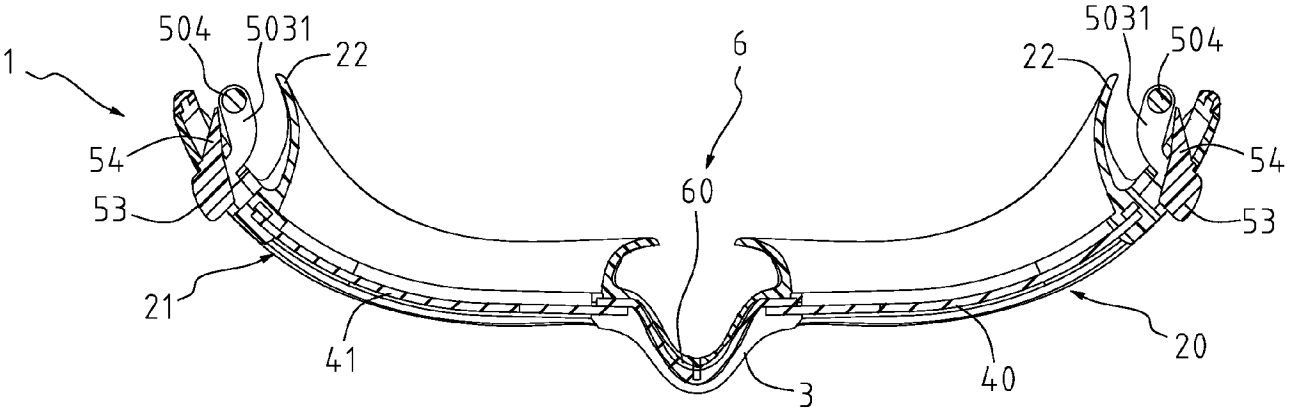
FIG. 4 is a cross-sectional view taken along the line 4-4 in FIG. 3.
Figure 3:
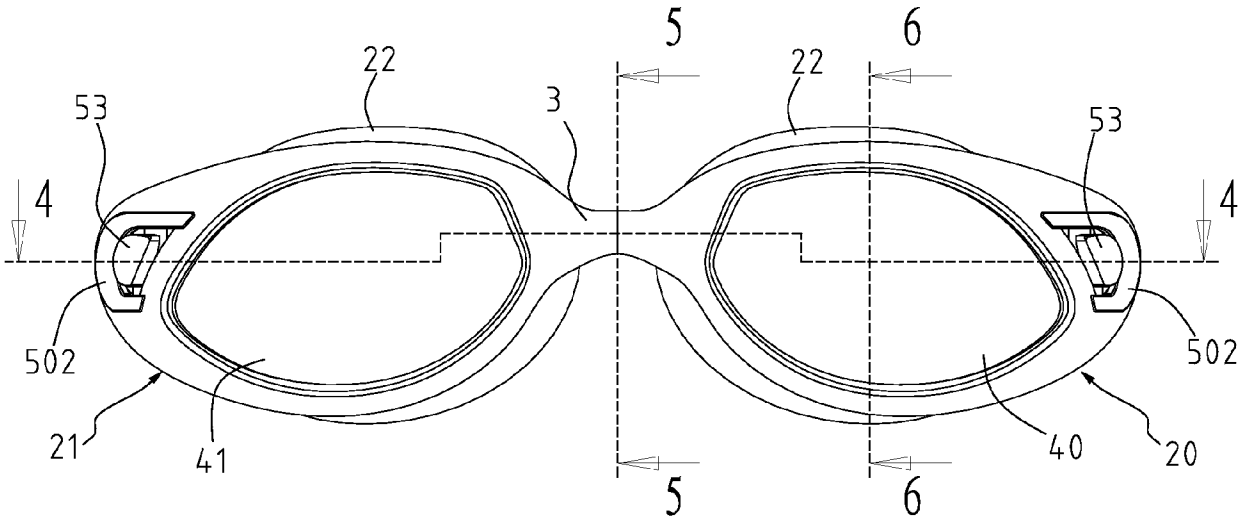
FIG. 3 is a front view of the swimming goggles of FIG. 2.
Figure 6:
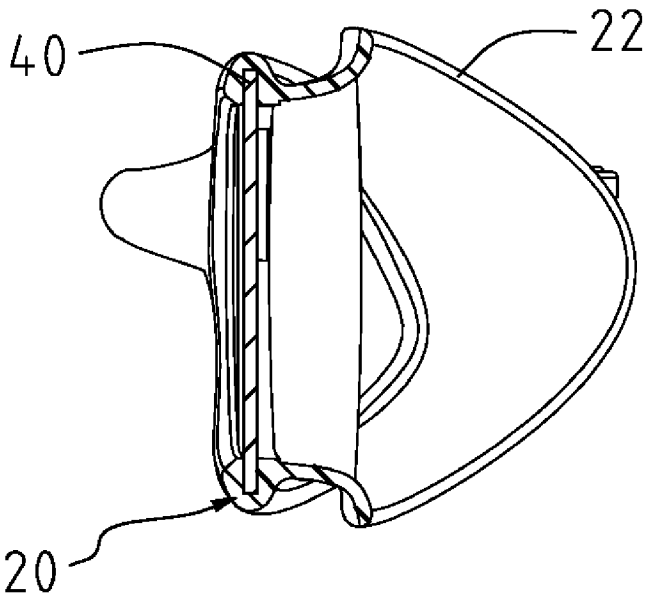
FIG. 6 is a cross-sectional view taken along the line 6-6 in FIG. 3.
Figure 5:
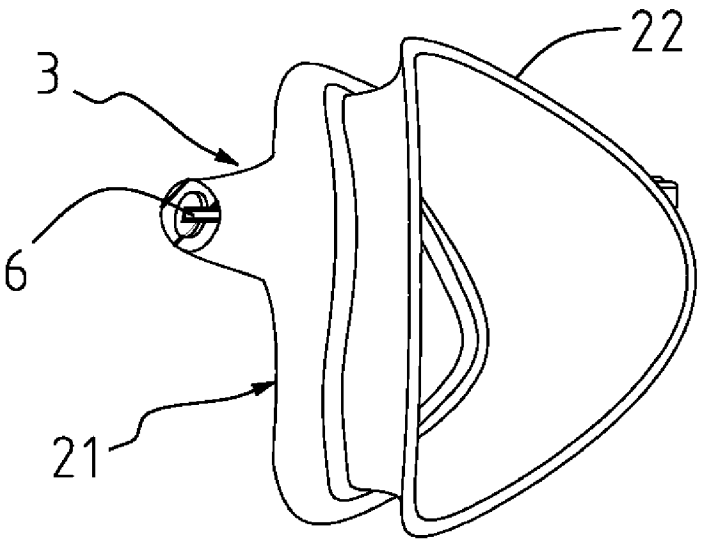
FIG. 5 is a cross-sectional view taken along the line 5-5 in FIG. 3.
Figure 7:
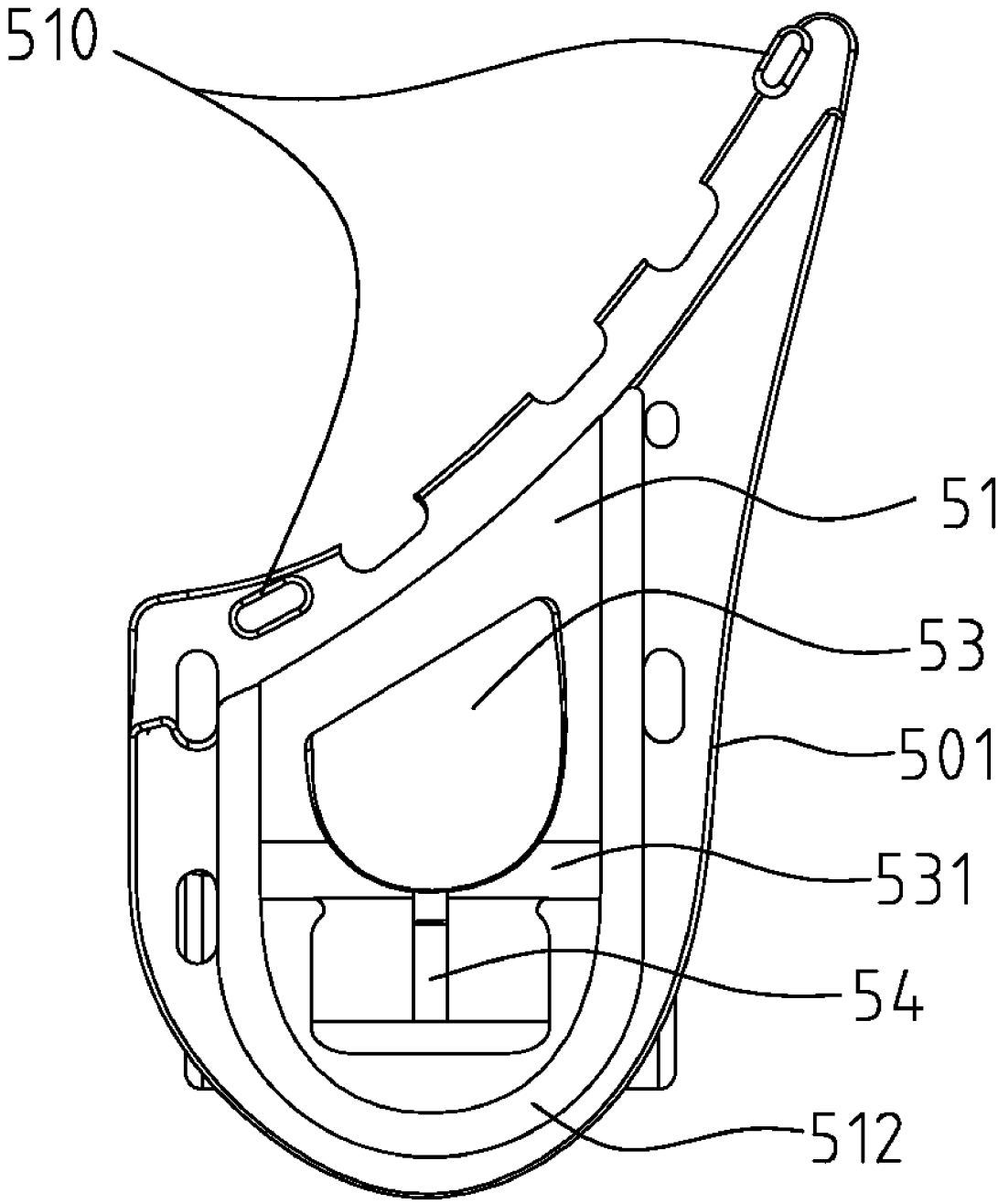
FIG. 7 is an enlarged, planar view of a first plate of a buckle of the present invention.

The buckles 5 are assembled on the assembling holes 204, 214. Each buckle 5 includes a base 50 consisting of a first plate 501 and a second plate 502. The first plate 501 is slightly larger than the assembling hole 204/214 and is assembled on the inward surface 201/211 of the left frame 20/the right frame 21. The first plate 501 forms L-shaped bars 5021, 5031 symmetrical to each other, and a transverse bar 504 straddling on the L-shaped bars 5021, 5031. An extending hole 505 is defined among the L-shaped bars 5021, 5031 and the transverse bar 504 for accommodating a head strap (not shown). The first plate 501 defines a first opening 51 at a side thereof. A first embedding portion 510 is defined on a peripheral of the first opening 51 for mounting with the first latch 42. According to one embodiment of the present invention, the first embedding portion 510 includes three first positioning pegs on a peripheral of the first plate 501. Positioning holes 511 are defined in a peripheral of the first opening 51. An L-shaped flange 512 is defined along the peripheral of the first opening 51 for limiting movement of a button 53. The button 53 is formed on an inward side of the first opening 51. The button 53 is unitarily formed with the L-shaped flange 512 through a connecting bar 531 to comply with leverage principle. An abutting arm 54 (see FIGS. 4 and 7) is formed near the extending hole 505. In use, the button 53 is pressed downwardly, and the connecting bar 531 deforms. The abutting arm 54 is controlled to move forth and back by resiliency of the material.

The second plate 502 substantially has the same area as that of the assembling hole 204/214, and is assembled on the assembling hole 204/214 and corresponding to the first plate 501. A second opening 52 is defined corresponding to the first opening 51 of the first plate 501. Positioning tabs 521 are formed on a peripheral of the second opening 52 for engaging with the positioning holes 511 of the first plate 501.

The nose support 6 is made of Polypropylene (PP), Nylon, or the like. The nose support 6 is unitarily formed and is bent to fit for a user's nose profile. The nose support 6 is disposed between the lenses 40, 41 and includes a middle portion 60, and second embedding portions 61 on both sides of the middle portion 60 for assembling with the second latches 43 of the lenses 40, 41. According to one embodiment of the present invention, the second embedding portions 61 include second positioning pegs on both sides of the middle portion 60. Through holes 62 are respectively defined in opposite sides of the middle portion 60 for stuffing plastic while shaping, thereby reinforcing assembly.

Figure 2:
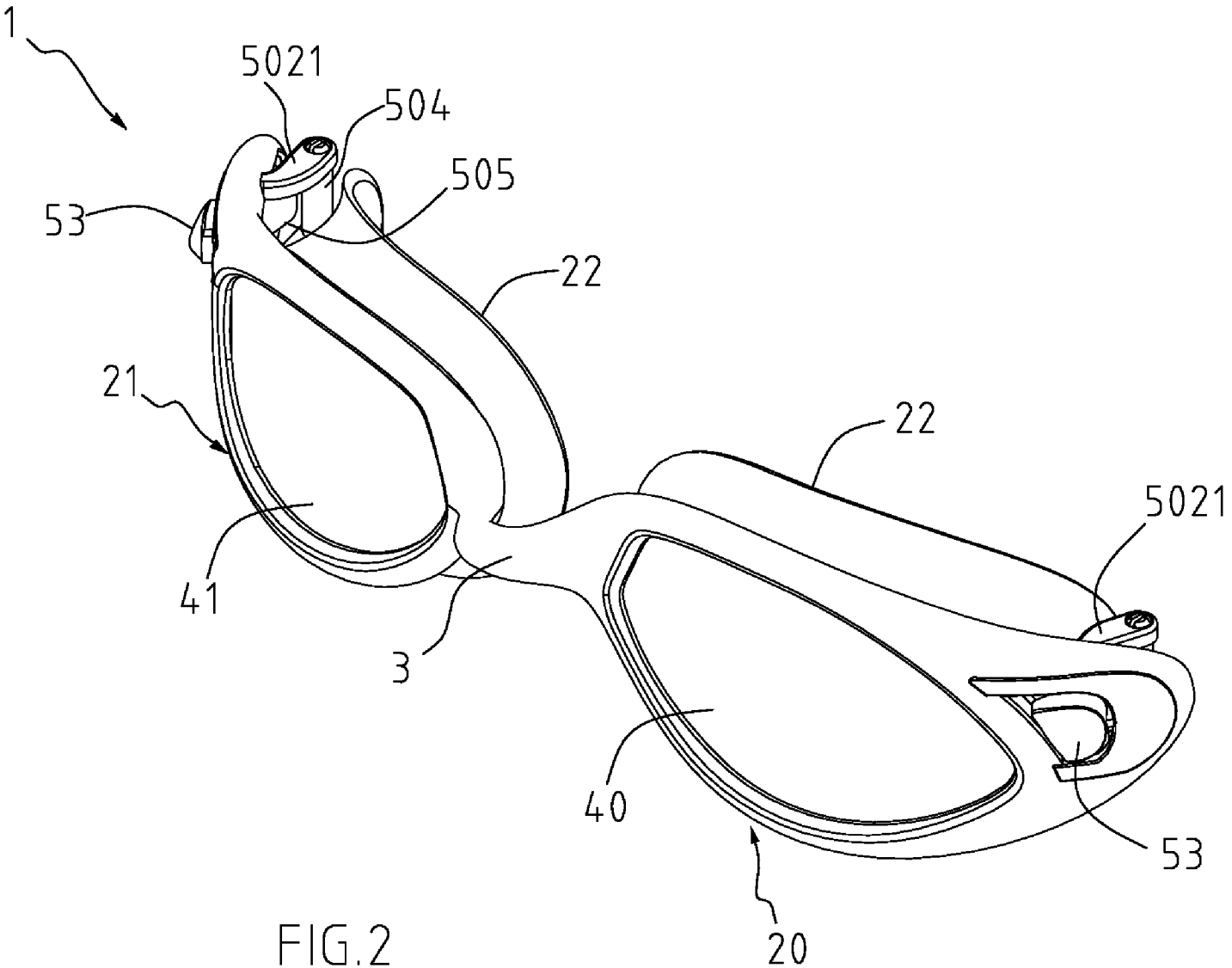
FIG. 2 is an assembled view of the swimming goggles of FIG. 1.

Referring to FIGS. 1-6, in assembly, the first embedding portions 510 of the buckles 5 engage with the first latches 42, and the second embedding portions 61 of the nose support 6 engage with the second latches 43 of the lenses 40, 41, thereby assembling the nose support 6 and the buckle 5 with the lenses 40, 41. The left frame 20, the right frame 21 and the connecting member 3 are integrally formed. As shown in FIG. 2, an outer layer of the swimming goggles is made of soft material, while the enwrapped buckles 5 and the nose support 6 are made of rigid material. Therefore, the pads 22 of the left frame 20 and the right frame 21 cover a user's eyehole softly. Furthermore, the nose support 6 is formed unitarily and covered by the connecting member 3, and is bent to fit for a user's nose bridge. When the swimming goggles are worn, the nose support 6 touches a user's nose bridge closely. The buckles 5 are made of rigid material, and therefore pulling of the head strap will not result in deformation of the swimming goggles. Thus the swimming goggles are worn conveniently and comfortably, and guard against water leakage.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising:

a left frame, a right frame and a connecting member being integrally shaped, the left frame and the right frame respectively forming inward surfaces and outward surfaces, passageways being respectively defined between the inward surfaces and the outward surfaces, assembling holes being respectively defined in outward sides of the left frame and the right frame;

a pair of lenses being respectively received in the passageways, and respectively having first latches beside outward sides of the left frame and the right frame, and second latches beside inward sides of the left frame and the right frame, a plurality of injection holes being defined in peripherals of the lenses;

buckles being respectively assembled on the assembling holes, each buckle including a base, an extending hole being defined in the base, a first embedding portion being defined in the base and mounted with the first latch; and a nose support disposed between the lenses and including a middle portion, and second embedding portions on both sides of the middle portion being assembled with the second latches of the lenses;

wherein the nose support, the buckles and the lenses are assembled together, and are then assembled with and attached to the integrally shaped left frame, right frame and connecting member so that the nose support is covered by the connecting member.

2. The swimming goggles as claimed in claim 1, wherein the first latches and the second latches respectively include a plurality of embedding holes in the lenses, and wherein the first embedding portions include first positioning pegs on the buckles, and the second embedding portions include second positioning pegs on both sides of the nose support.

3. The swimming goggles as claimed in claim 2, wherein the base consists of a first plate and a second plate, the first plate being slightly larger than the assembling hole and being assembled on the inward surface of the left and the right frames, the first plate forming L-shaped bars symmetrical to each other, and a transverse bar straddling on the L-shaped bars, the extending hole being defined among the L-shaped bars and the transverse bar, the second plate substantially having the same area as that of the assembling hole, and being assembled on the assembling hole and corresponding to the first plate.

4. The swimming goggles as claimed in claim 3, wherein the first embedding portion includes three first positioning pegs on a peripheral of the first plate.

5. The swimming goggles as claimed in claim 4, wherein the first plate defines a first opening, and the second plate defines a second opening corresponding to the first opening of the first plate.

6. The swimming goggles as claimed in claim 5, wherein positioning holes are defined in a peripheral of the first opening, and wherein positioning tabs are formed on a peripheral of the second plate for engaging with the positioning holes of the first plate.

7. The swimming goggles as claimed in claim 6, wherein an L-shaped flange is defined along the peripheral of the first opening for limiting movement of a button of the first plate.

8. The swimming goggles as claimed in claim 7, wherein the button is formed on an inward side of the first opening of the first plate, the button being unitarily formed with the L-shaped flange through a connecting bar to comply with leverage principle, an abutting arm being formed near the extending hole, in use, the button being pressed downwardly and the connecting bar deforming, the abutting arm being controlled to move forth and back by resiliency of material.

9. The swimming goggles as claimed in claim 1, wherein the nose support is unitarily formed and is bent to fit for a user's nose profile.

10. The swimming goggles as claimed in claim 1, wherein the left frame, the right frame and the connecting member are made of Thermoplastic Rubber (TPR).

11. The swimming goggles as claimed in claim 10, wherein pads are respectively formed on the inward surfaces of the left frame and the right frame, and the pads are softer than the left frame and the right frame.

12. The swimming goggles as claimed in claim 9, wherein the nose support is made of one of Polypropylene (PP) and Nylon.

13. The swimming goggles as claimed in claim 12, wherein through holes are respectively defined in opposite sides of the middle portion for stuffing plastic while shaping, thereby reinforcing assembly.

* * * * *